US005187966A

United States Patent [19]

Seconde et al.

[11] Patent Number: 5,187,966

[45] Date of Patent: Feb. 23, 1993

[54] METHOD AND DEVICE FOR DRAWING CONTAINERS OF FRUSTOCONICAL SHAPE AND A CONTAINER DRAWN THEREBY

[75] Inventors: Jean-Francois Seconde, Metz; Gerard Heurteboust, Roussy Le Village, both of France

[73] Assignee: Sollac, Puteaux, France

[21] Appl. No.: 895,142

[22] Filed: Jun. 5, 1992

Related U.S. Application Data

[63] Continuation of Ser. No. 624,311, Dec. 4, 1990, abandoned.

[30] Foreign Application Priority Data

Dec. 11, 1989 [FR] France ..... 89 16445

[51] Int. Cl.[5] ..... B21D 22/26

[52] U.S. Cl. ..... 72/329; 72/348

[58] Field of Search ..... 72/308, 309, 329, 334, 72/336, 348, 351, 379.4

[56] References Cited

U.S. PATENT DOCUMENTS

| | | | |
|---|---|---|---|
| 1,453,652 | 5/1923 | Auble et al. . | |
| 1,551,832 | 9/1925 | Miller et al. . | |
| 2,312,749 | 3/1943 | Bullock . | |
| 2,968,270 | 1/1961 | McChesney | 762/354.8 |
| 3,000,274 | 9/1961 | Duskey et al. | 72/348 |
| 3,252,315 | 5/1966 | Muench | 72/309 |
| 3,302,441 | 2/1967 | Bozek . | |
| 3,372,569 | 3/1968 | Bozek | 72/334 |
| 3,443,412 | 5/1969 | Webb | 72/348 |
| 3,580,041 | 5/1971 | Tilly et al. | 72/348 |

FOREIGN PATENT DOCUMENTS 1452963 4/1969 Fed. Rep. of Germany .

*Primary Examiner*—Lowell A. Larson

*Attorney, Agent, or Firm*—Frishauf, Holtz, Goodman & Woodward

[57] ABSTRACT

The device comprises a punch (2) of frustoconical shape and a die (1). The die comprises concentric rings (8, 9, 10) movable in the direction of the displacement of the punch, and pressure means (14, 15, 16) for exerting on the rings a predetermined force in the direction toward the punch, each of the annular front surfaces (20, 21, 13) of the rings having a shape which is complementary to the annular surface (20', 21', 13') of the punch in axially facing relation thereto. According to the method of the invention for in particular manufacturing in a single stroke a container of generally frustoconical shape, concentric annular zones (32, 33, 34) of the blank are deformed in succession by commencing with that having the smallest size, each annular zone (32, 33, 34) being maintained pressed toward the punch by a corresponding ring (respectively 10, 9, 8) from the moment when the zone is in contact with the punch until the end of the drawing operation, each annular zone being moreover in bearing relation to a corresponding ring so long as the inner adjacent zone is not applied against the punch.

21 Claims, 5 Drawing Sheets

Figure 1B:
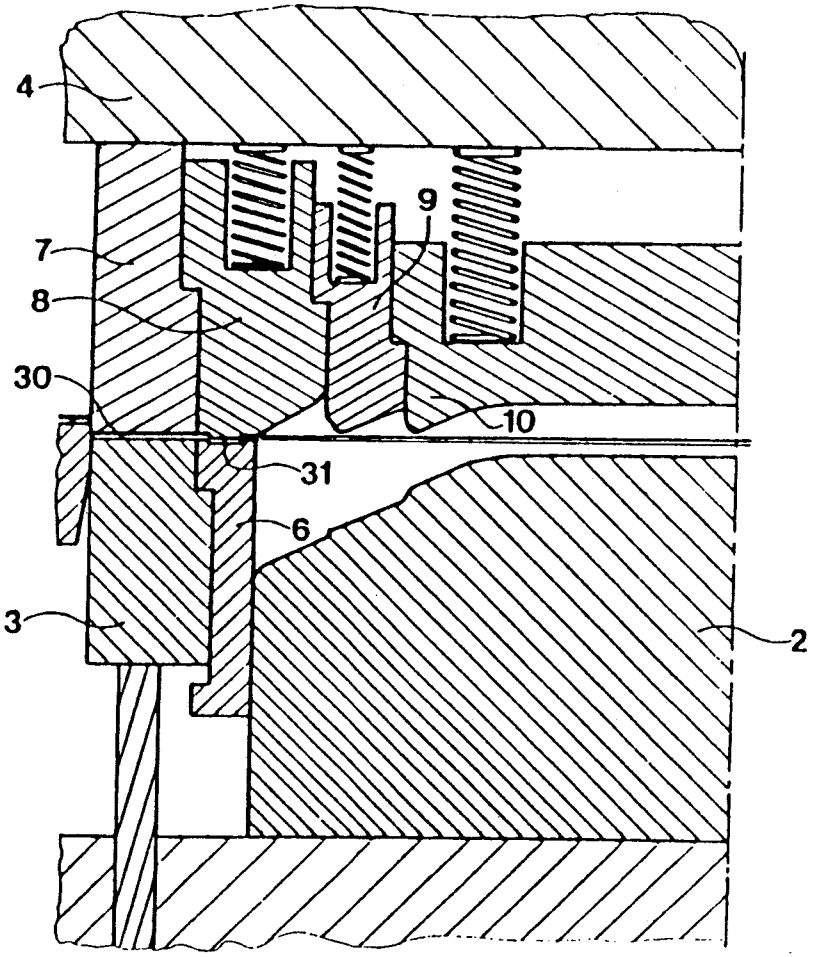

METHOD AND DEVICE FOR DRAWING CONTAINERS OF FRUSTOCONICAL SHAPE AND A CONTAINER DRAWN THEREBY

This application is a continuation of application Ser. No. 07/624,311, filed Dec. 4, 1990, now abandoned.

The invention relates to the manufacture of containers of generally frustoconical shape by the drawing of a blank of sheet metal, in particular of thin steel. It relates more particularly to the manufacture of highly tapered containers, i.e. the lateral wall of which is widely flared adjacent to the opening of the container.

According to conventional methods for manufacturing this type of container, there are effected in succession a plurality of drawing sequences which progressively deform the initial blank until the final product is obtained. These methods which therefore require the use of a plurality of press tools, namely one per sequence, and a plurality of operations for producing a container, result in a high manufacturing cost.

In order to reduce these costs, it has already been proposed to draw frustoconical containers in a single stroke by employing a punch and die both of which are frustoconical. However, such methods have a tendency to result in a bulging shape and wrinkling of the tapered lateral wall of the container owing to the large free marginal portion inherent in this type of method. It should be noted that the free marginal portion is the annular zone of the blank located between the punch and the die which is neither in contact with the punch nor in contact with the die in the course of the drawing operation, i.e. in the case of a frustoconical punch and die and just before the end of the drawing operation, substantially the whole of the lateral wall of the container.

To avoid this wrinkling it has been proposed in the document U.S. Pat. No. 3,302,441 to reduce this free marginal portion by employing a punch consisting of a plurality of concentric annular rings sliding one inside the other. In this case, the drawing operation is carried out in such a manner as to first of all deform by means of the outer annular ring of the punch, a first annular zone of the blank so as to shape the frustoconical part of largest diameter of the container, i.e. the part which is the closest to the opening of the container, then to deform in succession, by means of annular rings of decreasing diameters, corresponding annular zones of the blank so as to form frustoconical parts of the blank which are also of decreasing diameters up to the end of the drawing operation when the whole of the frustoconical wall of the drawn container is applied against the die by the different annular rings of the punch. With this prior art method, the free marginal portion in the course of the drawing operation is indeed considerably reduced, since it consists solely of said annular zones, the width of which is substantially divided, relative to the preceding case, by the number of annular rings of the punch.

However, this method has the drawback of greatly limiting, (right from the start of the drawing operation), the flow of the metal of the blank between the die and the outer ring of the punch. Consequently, the subsequent deformations brought about by the other rings of decreasing diameter result in a large amount of drawing of the metal in the central zone of the blank which might result in its fracture, in particular in the case of a thin blank. Further, tears might occur as a result of high friction of the deformed zone of the blank between the die and the outer ring of the punch.

An object of the present invention is to overcome these problems and to permit the manufacture of containers of generally frustoconical shape by effecting a drawing operation on thin, or very thin, sheet metal blanks, in particular of steel.

With this object in view, the present invention provides a method for drawing a sheet metal blank for manufacturing in a single stroke a container of generally frustoconical shape, the expression frustoconical shape being intended to mean not only containers of circular section, but also containers having a generally polygonal-shaped section, and in which the section in a plane passing through the centre of the container may be on the whole rectilinear or curvilinear with a more or less pronounced concavity or convexity.

According to the invention, this method is characterized in that a draw tool is employed which comprises a frustoconical punch and a die comprising, in facing relation to the frustoconical surface of the punch, concentric rings which are movable in a direction perpendicular to the plane of the blank, concentric annular zones of the blank are deformed in succession by commencing with that of the smallest dimension, each annular zone of frustoconical shape after deformation, being maintained pressed toward the punch by a corresponding ring from the moment when said zone is in contact with the punch and to the end of the drawing operation, each annular zone moreover bearing against a corresponding ring so long as the inner adjacent annular zone is not applied against the punch.

By means of the invention it is possible to manufacture by a drawing operation in a single stroke containers of frustoconical shape from thin sheet metal substantially without risk of fracture of the blank. Indeed, as the deformation of the blank occurs first of all in its central part close to the bottom of the container, the subsequent successive deformations of the zones of increasing diameter substantially do not intervene on the already-deformed metal of the zones of smaller dimensions and therefore have no tendency to excessively draw on the metal thereby avoiding fractures which usually occur closest to the nose of the punch in the methods of the prior art. On the other hand, the metal required for absorbing these deformations is freely, apart from the effect of the pressure exerted by the blank holder, brought from the peripheral zones of the blank. It is consequently possible to easily control the deformations resulting from a drawing of the metal by adapting the pressures exerted on the drawn blank by the various rings of the die and by the blank holder.

There also results, as compared with a drawing operation in a plurality of strokes, a saving as concerns the dimensions of the blank, since the drawing of the metal of the blank may be controlled and therefore optimized.

In a particular arrangement of the invention, each annular zone is maintained substantially in the plane of the blank so long as the inner adjacent annular zone is not applied against the punch.

This particular arrangement permits, apart from the fact of permanently controlling the free marginal portion by contact of the blank with the annular rings of the die, maintaining firmly pressed between the punch and the die each drawn annular zone before the outer adjacent zone starts to be deformed by the action of the punch and the corresponding die ring. The influence of the deformation of an annular zone on the inner adjacent zones is therefore still further reduced.

However, the rings may also move slightly in accompanying the zone of the blank which is the free marginal portion under the effect of a reduced pressure exerted on said rings, this pressure being adapted to the buckling characteristics of the material of the blank. It may moreover be admitted that, in the course of the drawing operation, an annular zone of the blank is not completely pressed by the corresponding ring on the punch when the outer adjacent annular zone starts to be deformed. Even in this case, in the course of the drawing operation, the zone of the blank corresponding to the free marginal portion progressively diminishes and this has for effect to reduce risks of wrinkling.

However, the sequential blocking of the blank on the punch brought about by the rings of increasing size, produces in a drawing effect which increases as the free marginal portion decreases and the thickness of the frustoconical walls is correspondingly more constant.

According to another particular arrangement, the punch comprises on its frustoconical surface one or more circumferential offsets, and corresponding steps are formed on the wall of the container in the course of the drawing operation between two adjacent annular zones of said wall, in succession when an annular zone is put in contact with the punch by the corresponding ring.

This arrangement permits producing a container having on its tapered lateral wall steps which, apart from their aesthetic aspect, constitute reinforcements of the wall. Further, the formation of these steps produces at the end of the deformation of each annular zone an additional tension of the metal in said annular zone which participates in the suppression of possible wrinkling.

For the same purpose, it is also possible, by employing a punch including steps, to bring in the course of the drawing operation each annular zone of the blank in contact with the corresponding zone of the punch by means of the corresponding die ring without actually forming the step, the contact being then merely linear on a corner or edge of the step, and to simultaneously form all the steps at the end of the drawing operation by a simultaneous increase in the pressure exerted by the rings of the die.

The invention also provides a draw device for carrying out the method described hereinbefore, this device being characterized in that the die comprises in facing relation to the frustoconical surface of the punch, concentric rings which are movable in the direction of the displacement of the punch, and pressure means for exerting on said rings a predetermined force in the direction toward the punch, the annular front surface of said rings having a shape which is complementary to the annular surface of the punch in axially facing relation thereto.

In a particular arrangement, the pressure means comprise elastic elements such as springs designed to exert on each ring of the die a force which is a function of the depth of penetration of the punch in the die.

Further features and advantages will be apparent from the following description given by way of example of a device and a method for carrying our the invention, for manufacturing widely flared containers such as dishes from steel sheet having a thickness of less than 0.21 mm, for example 0.18 mm.

Figure 1A:
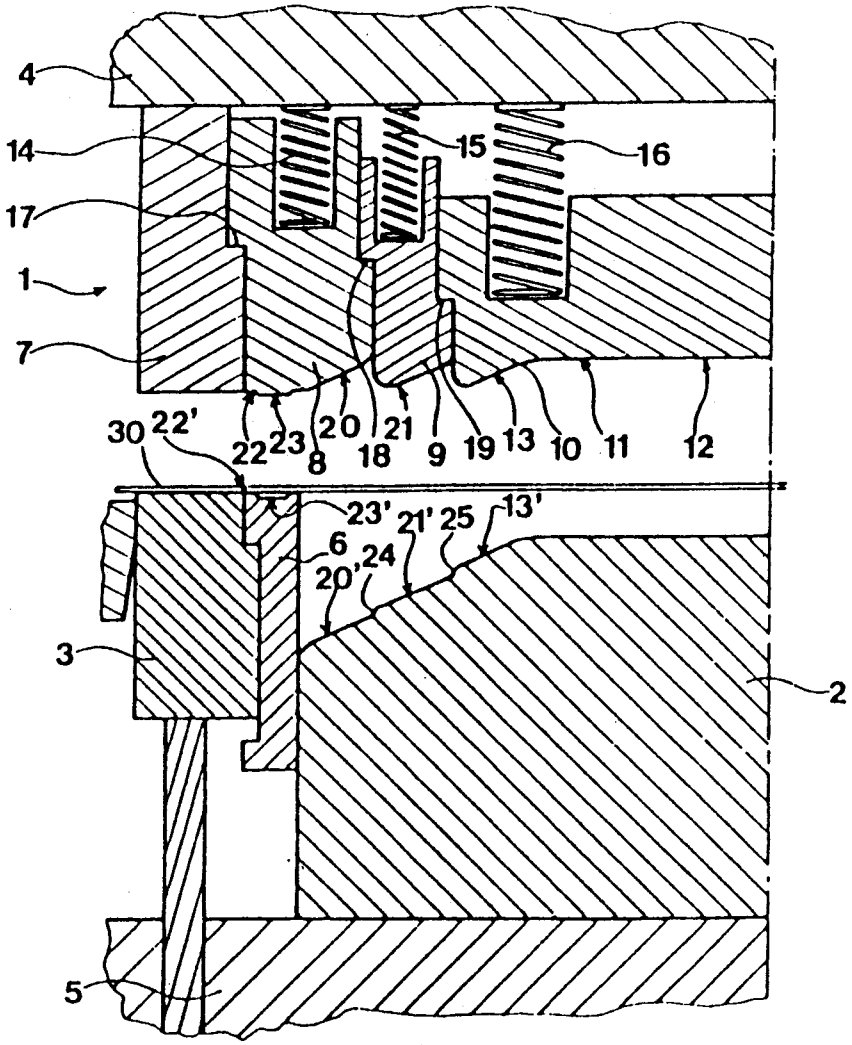
Figure 1D:
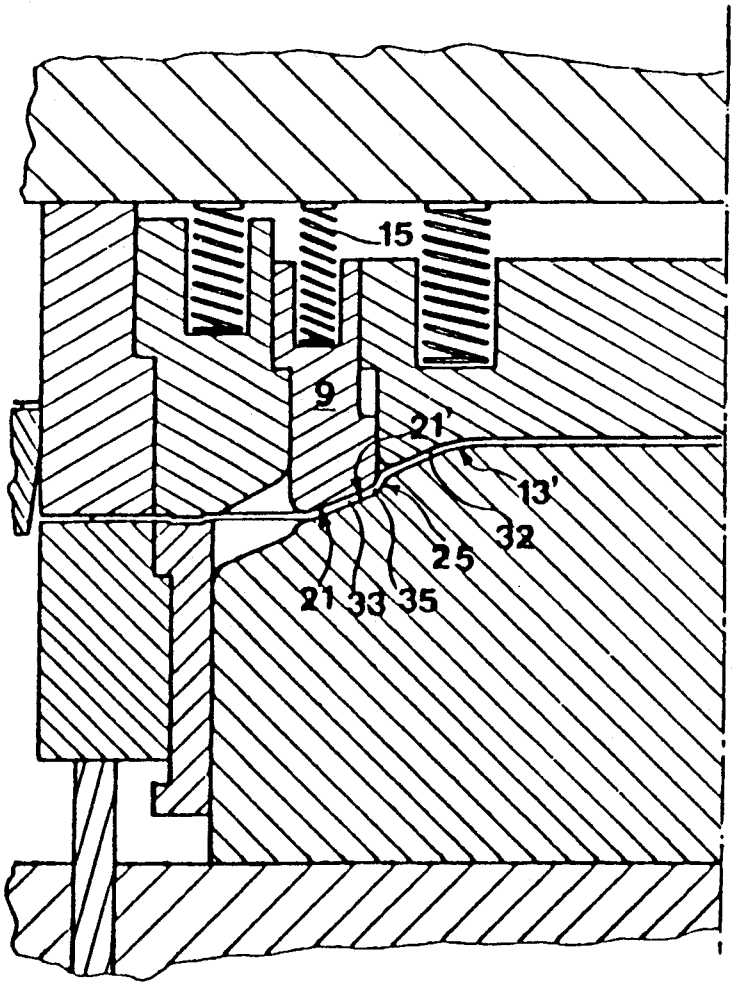
Figure 1C:
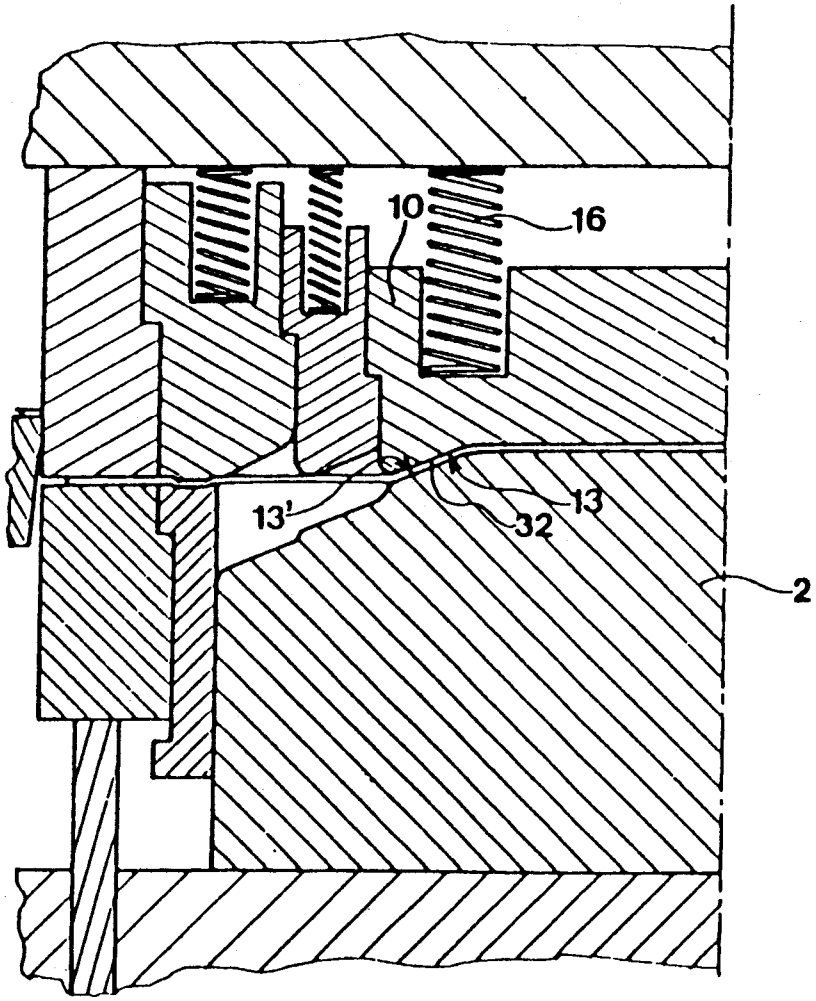
Figure 1F:
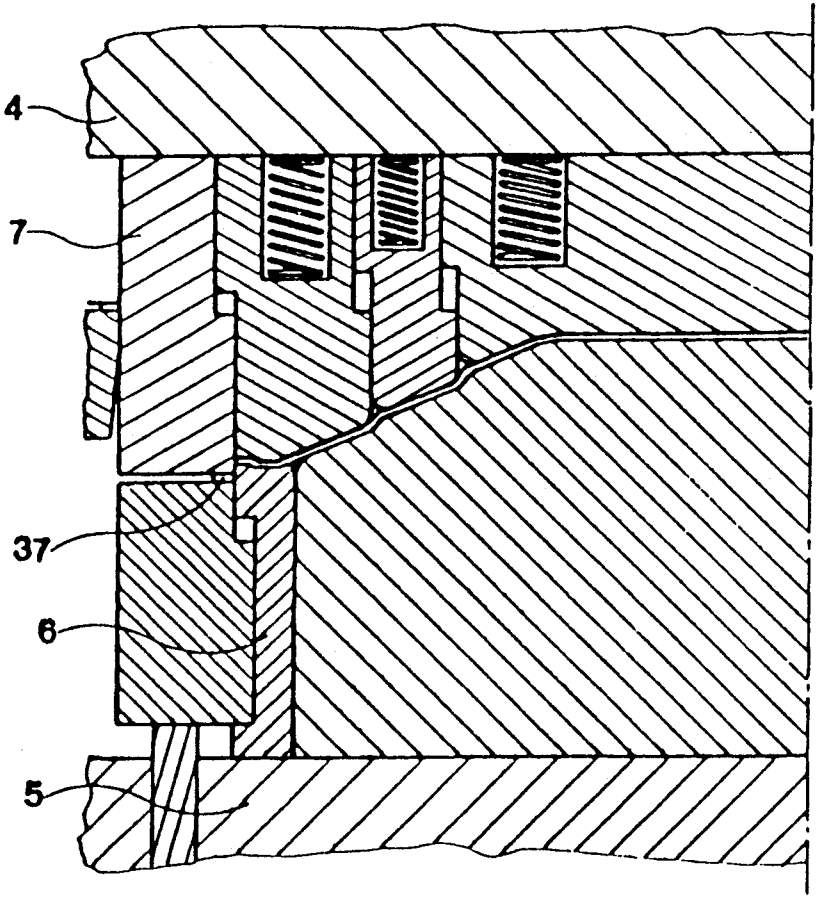
Figure 1E:
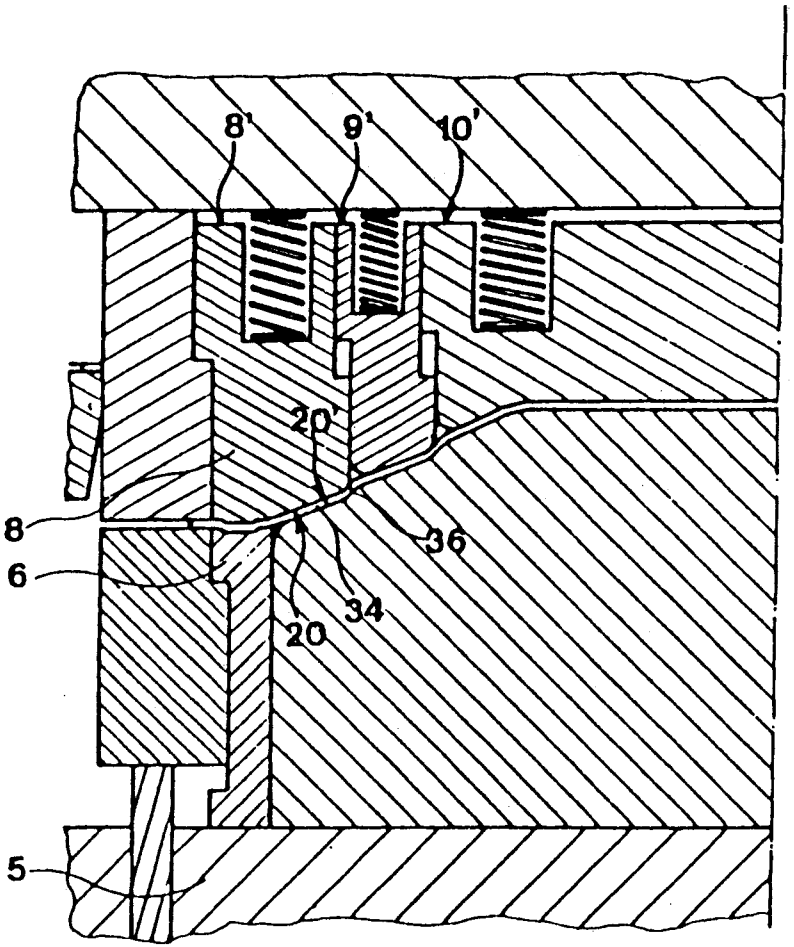
Figure 3:
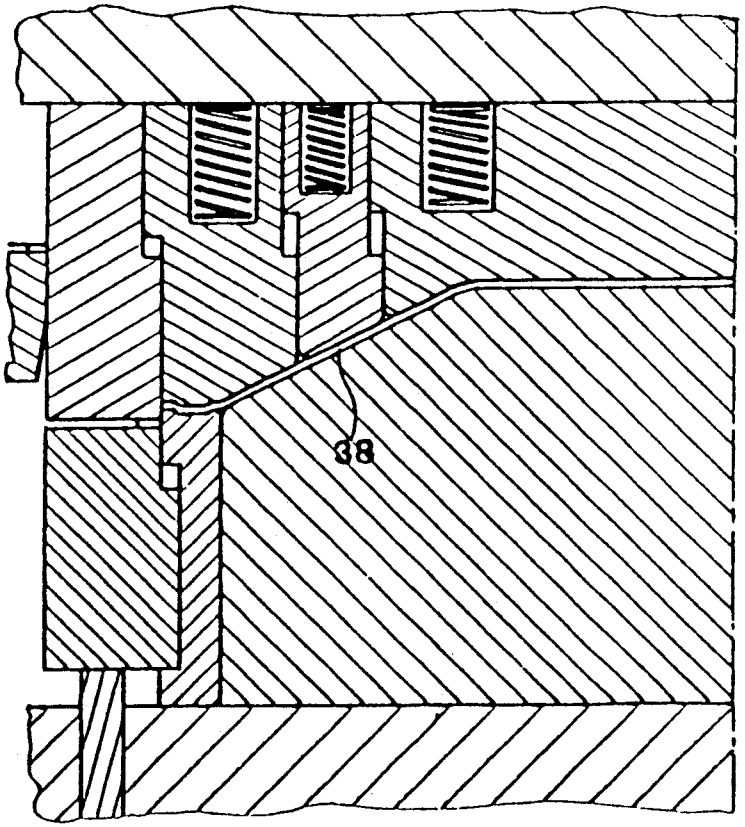
Figure 2:
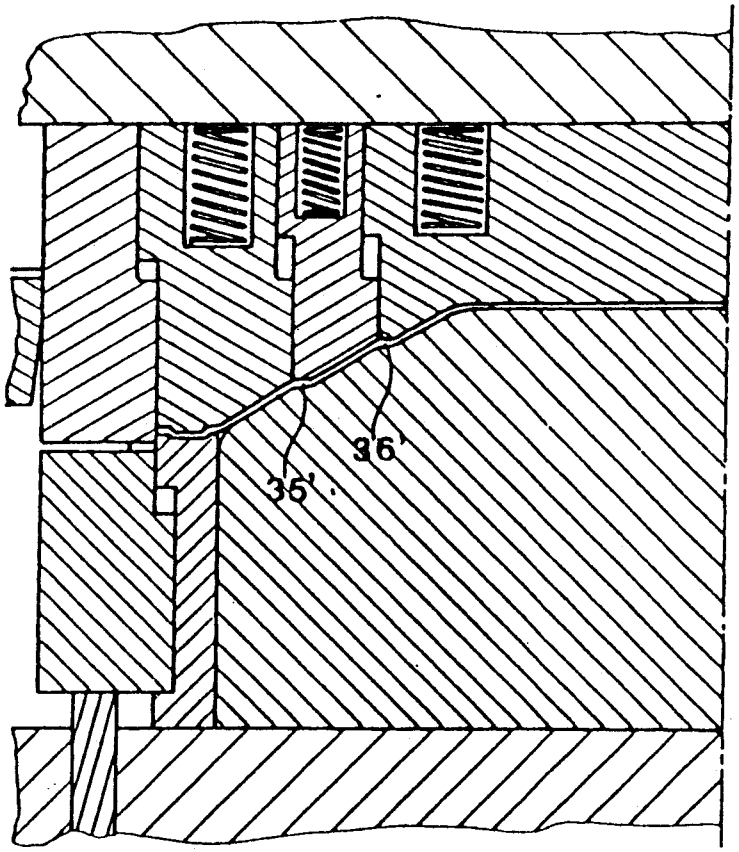
Figure 4:
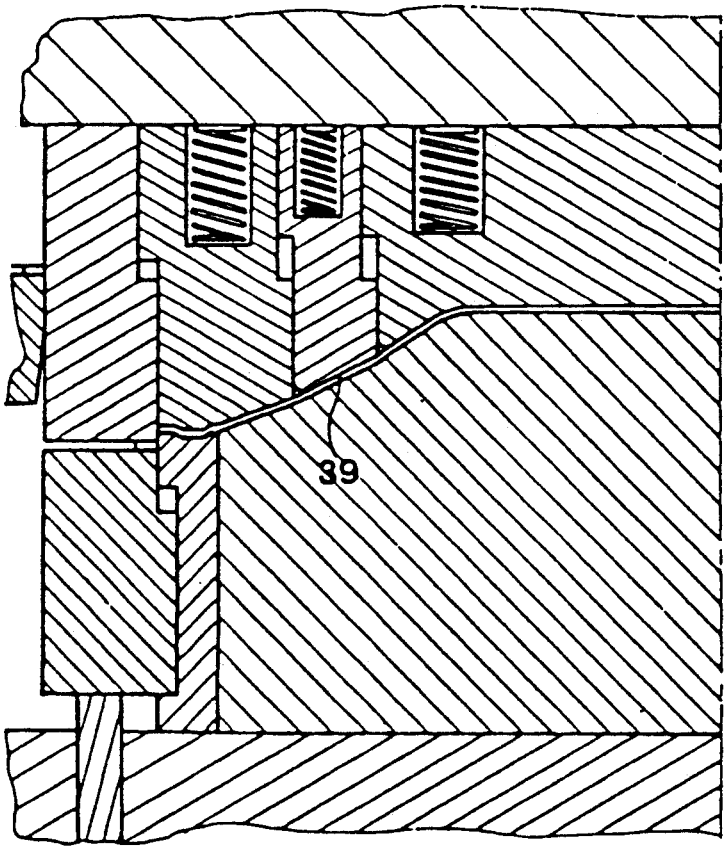

In the accompanying drawings:

FIGS. 1*a* to 1*f* are semi-axial sectional views of the draw device and the blank in the course of the different successive stages of the drawing of a stepped dish, FIG. 2 shows a variant of the device at the end of the drawing of another form of dish, FIG. 3 shows another variant applied to the drawing of dishes having a smooth lateral wall, FIG. 4 shows another variant applied to the drawing of dishes having a lateral wall of curved section.

The draw tool shown in the various Figures comprises a die 1, a frustoconical punch 2 and a blank holder 3. The die 1 is connected in the known manner to an upper plate 4 of a draw press. Likewise, the punch is connected to a lower plate 5 of said press. The blank holder 3 is slidably mounted on the lower plate 5, means (not shown) being provided for exerting a pressure on the blank holder 3 in the direction toward the die 1. Interposed between the blank holder 3 and the punch 2 is a blanking ring 6 adapted in particular to effect at the end of the drawing operation the peripheral blanking of the edge of the container.

The die 1 comprises a fixed ring 7 rigidly secured to the upper plate 4 of the press, and a plurality of concentric rings 8, 9, 10, namely three in the illustrated embodiment. The central ring 10 is in this embodiment a disc whose face 11 facing the punch includes a planar central zone 12 surrounded by a frustoconical zone 13, this central ring 10 being adapted to form the bottom of the container and the part of the lateral wall of the latter adjacent to the bottom.

As will be understood hereinafter, this disc may be replaced by an annular ring having a frustoconical surface identical to the surface 13, and a central counter-punch for forming, in cooperation with the central part of the punch, the bottom of the container. The surface of the central zone 12 or of the counter-punch could also be so shaped as to impart to the bottom of the container a special relief.

The concentric rings 8, 9, 10, are slidably mounted relative to one another and are permanently urged toward the punch by pressure means such as springs 14, 15, 16. These rings, whose maximum movement is determined in accordance with the draw depth, are moreover retained by abutments 17, 18, 19 which limit their displacement in the direction toward the punch, so that the lower ends of these rings are all substantially in the same plane before the drawing operation.

Further, said springs are so designed for each ring as to be capable of exerting on the drawn blank sufficient force to place close against the punch the annular zone of the blank which is located in facing relation to said ring in the course of the drawing operation.

Each ring defines a frustoconical surface 20, 21, 13 having the same taper as the annular surfaces 20', 21', 13' of the punch respectively in facing relation thereto. The outer slidable ring 8, i.e. that having the largest diameter, further defines a substantially planar surface 22 adjacent to its frustoconical surface 20 in facing relation to a surface 22' of the blanking ring 6 and preferably including an annular projection or bead 23. An annular recess 23' of corresponding cross-section is provided in the blanking ring 6. Said bead 23 and said recess 23' are in particular adapted to form on the edge portion of the container a peripheral rib constituting a thermosealing path for the subsequent welding of a closing lid of the container. This arrangement permits moreover ensuring the flatness at the end of the drawing operation of said thermosealing path which guarantees the continuity and therefore the sealing effect of the weld when closing the container.

The frustoconical annular surfaces 20', 21', 13' of the punch are moreover interconnected by offsets 24, 25 which form with said annular surfaces circumferential steps, these offsets being in facing relation to guide surfaces between the rings of the die.

With reference to FIGS. 1*a* to 1*f* representing the different drawing stages, there will now be described the method for drawing a sheet metal blank 30 so as to form a widely-flared frustoconical container, such as a dish.

In the first stage shown in FIG. 1*a*, the blank 30 is placed in position between the die and the punch which are spaced apart from each other, the blank resting on the blank holder 3 and the blanking ring 6 being maintained in an upper position by the pressure means of the blank holder. The slidable rings 8, 9, 10 are urged downwardly by the springs 14, 15, 16, the lower ends of these rings and of the fixed ring 7 of the die being substantially in the same horizontal plane.

The upper plate 4 of the press is then driven downwardly until the fixed ring 7 of the die comes in contact with the blank and presses the latter against the blank holder 3.

In this second stage shown in FIG. 1*b*, the peripheral portion of the blank is therefore gripped between the fixed ring 7 of the die and the blank holder 3, and the annular zone 31 of the blank located between the outer ring 8 of the die and the blanking ring 6 is deformed by the bead 23, the force exerted on the outer ring 8 by the springs 14 being sufficient to prevent or limit its upward retraction. In addition to the function mentioned before of forming the thermosealing path, the bead 23 associated with the recess 23' in this way participates, as a complement to the pressure exerted by the blank holder, in the retention of the peripheral portion of the blank by successive folding and unfolding of the latter when the blank slips between the outer ring and the blanking ring in the course of the following stages of the drawing operation.

In this second stage, shown in FIG. 1*b* the lower ends of the rings 9 and 10 are just in contact with the blank and thenceforth participate in the maintenance of the free marginal portion, as mentioned before.

As the upper plate 4 continues to be driven downwardly, the blank then starts to be drawn in its central portion by the interaction of the central ring 10 and the punch 2.

At the end of this third stage shown in FIG. 1*c*, the annular zone 32 of the blank adjacent to the bottom of the container is drawn and pressed against the frustoconical surface 13 of the central ring 10 and the corresponding surface 13' of the punch by the force exerted on said central ring 10 by the springs 16.

It will be observed that, in the course of this deformation of the blank, the peripheral portion of the blank has radially slipped between the fixed ring 7 of the die and the blank holder 3, and between the outer ring 8 and the blanking ring 6, the bead 23 participating in the regularity of this slipping throughout the periphery of the blank.

As the upper plate continues to descend, the punch continues to penetrate the die by upwardly urging the central ring 10 back with respect to the die and compressing the springs 16.

In the course of this fourth step, the blank continues to be deformed, the remaining free marginal portion being supported by the lower end of the slidable ring 9 adjacent to the central ring 10. The force exerted by the springs 15 on the ring 9, hereinafter termed the middle ring, is sufficient to preclude its rearward movement relative to the outer ring 8, the free marginal portion of the blank then remaining in the original horizontal plane of the blank. A certain rearward movement of this middle ring may however be accepted in that, notwithstanding this rearward movement, the deformation of the free marginal portion remains controlled by the pressure exerted by the lower end of the middle ring.

At the end of this fourth stage shown in FIG. 1*d* the annular zone 33 of the blank adjacent to the annular zone 32 is drawn and pressed between the frustoconical surface 21 of the middle ring 9 and the corresponding surface 21' of the punch by the force exerted on the middle ring 9 by the springs 15. Simultaneously, as a result of the offset 25 interconnecting the surfaces 21' and 13' of the punch, a step 35 is formed between the annular zones 32 and 33 of the blank.

The fifth stage is carried out in a similar manner to the fourth stage by continuing the descent of the upper plate 4, the continued penetration of the punch in the die causing the sliding of the middle ring 9 in the outer ring 8. The frustoconical annular zone 34 of largest diameter is then deformed and gripped between the frustoconical surface 20 of the outer ring 8 and the corresponding surface 20' of the punch, as shown in FIG. 1*e*, the step 36 being then formed in a similar manner to the step 35.

It will be observed that, at the end of this fifth stage, the blanking ring 6 abuts against the lower plate 5 and the upper surfaces 8', 9', 10' of the rings 8, 9, 10 are contained in the same plane.

Consequently, in the sixth and last stage of the drawing operation, these upper surfaces simultaneously come to abut against the upper plate 4, as shown in FIG. 1*f*. This sixth stage is a stage for blanking the periphery of the container, this blanking being effected upon the final penetration of the punch in the die, by the blanking ring 6 which, as it abuts against the lower plate 5, is displaced relative to the fixed ring 7 of the die simultaneously with the punch and shears or blanks the edge 37 of the blank in cooperation with the fixed ring 7.

At the end of this sixth stage, the drawing of the container has finished and it can be discharged from the draw tool in the known manner after the upper plate 4 has been raised and the various rings have returned to their initial position shown in FIG. 1*a*.

As already mentioned, forming the steps 35, 36 permits creating an additional tension of the metal of the blank which participates in the suppression of any possible subsisting wrinkles. In the description just given, the steps are formed in succession at the end of the fourth and fifth drawing stages. It will be easily understood that the same effect would be obtained if all the steps were formed simultaneously at the end of the drawing operation. This could result from the fact that, intentionally or otherwise, the pressure exerted on a ring, for example the middle ring 9, was insufficient to form the corresponding step. In this case, moreover, the annular zone 33 of the blank would not be completely pressed between the punch and the ring 9 at the end of the fourth stage. However, it would be maintained against the punch in proximity to the offset 25 in the fourth stage and in proximity to the offset 24 in the fifth stage.

FIGS. 2, 3 and 4 show, in the position corresponding to the end of the drawing operation, different variants of the draw device each of which is adapted to draw dishes of different shapes.

In the variant shown in FIG. 2, the steps 35', 36', instead of being formed by the cylindrical offsets such as those described hereinbefore, are formed by planar offsets in parallel planes. It will readily be understood that the lower ends of the slidable rings are adapted in consequence and that the method will be carried out in a similar manner to that previously described.

The same is true in respect of the variants shown in FIG. 3 in which the frustoconical wall 38 of the dish is smooth without steps, the generatrix of the lateral wall being rectilinear, and in FIG. 4 in which the wall 39 is made up of a plurality of frustoconical zones of increasing taper in the direction toward the periphery of the container, the generatrix of the wall being then generally curved.

It will be understood that the shape of the wall of the container is not intended to be limited to the various configurations given solely by way of example. In particular, the invention is also applicable to the manufacture of containers whose horizontal section is noncircular, the shape of the punch and of the various slidable rings being correspondingly adapted.

The method and device according to the invention are particularly adapted to the drawing of blanks of thin sheet steel, in particular less than 0.2 mm thick and having high mechanical characteristics (Re>450 MPa), but they may of course be employed for drawing thicker sheets or sheets of a different metal. They permit in particular the manufacture of containers of various shapes, in respect of which the slope of the walls, the depth of the container, and its dimensions may vary widely, the shape of the tools and in particular the number of rings being adapted in consequence.

What is claimed is:

1. A method for drawing a substantially flat sheet metal blank to manufacture, in one stroke, a container having a generally frustoconical shape, said method comprising:

providing a draw tool including:

a punch having a frustoconically shaped punch surface;

a die having a die surface positioned to face and cooperate with said frustoconically shaped punch surface of said punch when said die is in a fully operative position, to form the container; and a peripheral blank holder surrounding the punch;

positioning said sheet metal blank between said frustoconically shaped punch surface of said punch and the die surface of said die, said sheet metal blank having a principal plane and a peripheral edge portion;

forming the die surface of said die by positioning a plurality of movable concentric annular rings, including an innermost annular ring and an outermost annular ring, so that a top surface of each of said concentric annular rings faces a respective corresponding portions of said punch surface of said punch;

said plurality of movable concentric annular rings being movable respectively in a direction perpendicular to the principal plane of said sheet metal blank and toward said punch surface;

deforming said sheet metal blank in a succession of progressively larger concentric annular zones by successively pressing the annular zones of said sheet metal blank toward said punch surface by moving each of said concentric annular rings, commencing with the innermost concentric annular ring, toward said frustoconically shaped punch surface;

enabling said peripheral edge portion of said sheet metal blank to slide between the die and the blank holder during the deforming of said sheet metal blank;

contouring the top surface of each of said concentric annular rings to provide said die surface with an overall shape that is substantially complementary to that of the frustoconically shaped punch surface when said die surface presses said sheet metal blank against the punch surface;

maintaining the pressing of each of said zones of said sheet metal blank toward said frustoconically shaped punch surface from a moment when each of said concentric annular zones contacts said punch until the drawing of the container is completed; and urging a concentric annular ring to bear against a given annular zone of said sheet metal blank to deform said given annular zone as long as an adjacent inner annular zone adjacent said given annular zone remains separated from the frustoconically shaped punch surface, whereby the thus formed container is substantially completely supported by the punch surface and the die surface at the end of the drawing of the container, thereby preventing wrinkling of the container.

2. The method according to claim 1, further comprising:

maintaining each annular zone substantially in the principal plane of said sheet metal blank so long as the inner adjacent annular zone remains separated from the frustoconically shaped punch surface.

3. The method according to claim 1, wherein said frustoconically shaped punch surface of said punch includes at least one circumferential offset, said method further comprising:

forming of least one step on a wall of said container during the drawing of said container;

the at least one step being formed between two adjacent annular zones when one of said two adjacent annular zones is pressed to be in contact with said frustoconically shaped punch surface of said punch by a corresponding concentric annular ring.

4. The method according to claim 1, wherein said frustoconically shaped punch surface of said punch includes at least one circumferential offset, said method further comprising:

forming a separate step corresponding to each of said at least one circumferential offset simultaneously on a wall of said container at the end of the drawing of said container.

5. The method according to claim 1, further comprising forming a peripheral rib on a planar peripheral zone of said sheet metal blank to provide an edge portion of said container being drawn.

6. The method according to claim 1, comprising providing said die with at least three concentric annular rings.

7. The method according to claim 6, wherein the plurality of concentric annular rings includes a blanking ring, and further comprising:

positioning said sheet metal blank to slide between the outermost ring and the blanking ring during drawing of said container.

8. The method according to claim 1, wherein said sheet metal blank comprises a sheet of steel which is less than 0.21 mm thick.

9. A method for drawing a substantially flat sheet metal blank to manufacture in one stroke, a substantially wrinkle free container having a generally frustoconical shape, said method comprising:

providing a drawing tool including:

a punch having a frustoconically shaped punch surface;

a die having a die surface positioned to face and cooperate with said punch surface of said punch when said die is in a fully operative position, to form the container; and a peripheral blank holder surrounding said punch;

forming the die surface of said die to have a plurality of concentric segments including an innermost concentric segment and an outermost concentric segment;

positioning said sheet metal blank between said punch surface of said punch and the die surface of said die, said sheet metal blank having a principal plane and a peripheral edge portion;

contouring each of the plurality of concentric segments of said die surface to provide said die surface with an overall shape that is substantially complementary to the frustoconical shape of said punch surface when said die surface is in the fully operative position and presses said sheet metal blank against said punch surface;

deforming said sheet metal blank by moving said die in a direction perpendicular to the principal plane of said sheet metal blank and toward the frustoconically shaped punch surface of said punch so that the innermost concentric segment contacts, bears against and deforms said sheet metal blank first, followed by contact, bearing against and deformation of said sheet metal blank by successive ones of said plurality of concentric segments forming said die surface, until the outermost concentric segment of said die surface contacts, bears against and deforms said sheet metal blank;

enabling said peripheral edge portion of said sheet metal blank to slide between the die and the blank holder during the deforming of said sheet metal blank;

pressing each concentric annular segment forming said die surface to bear against and deform a respective zone of said sheet metal blank as long as an inner zone of said sheet metal blank, adjacent said respective zone, is not substantially fully pressed against a corresponding portion of said punch surface of said punch opposing said inner zone;

whereby the thus formed container is substantially completely supported by the punch surface and the die surface at the end of the drawing of the container, thereby preventing wrinkling of the container.

10. The method according to claim 9, wherein said sheet metal blank comprises a sheet of steel which is less than 0.21 mm thick.

11. The method of claim 9, comprising providing said die with at least three concentric segments.

12. A draw device for drawing a substantially flat thin steel sheet metal blank for manufacturing in a single stroke a container of generally frustoconical shape, said draw device comprising:

a punch having a punch surface of generally frustoconical shape;

a die comprising:

a plurality of concentric rings facing said punch surface, said concentric rings having annular top surfaces;

said concentric rings being movable toward the punch surface; and the respective top surfaces of said plurality of concentric rings having contoured shapes;

force extending means for exerting a predetermined force on said concentric rings to move the top surfaces of said concentric rings a predetermined distance in a direction toward said punch surface; and each of said annular top surfaces of said concentric rings having a shape which is contoured to be complementary to a corresponding annular surface portion of said punch surface that is in an axially facing relation thereto so that the top surfaces of said concentric rings provide the die with an overall die surface shape that substantially corresponds to the frustoconically shaped punch surface when the force exerting means moves the concentric rings said predetermined distance toward said punch surface.

13. The device according to claim 12, wherein said force exerting means comprise elastically yieldable elements.

14. The device according to claim 12, wherein said force exerting means comprise springs.

15. The device according to claim 12, wherein said force exerting means exerts a force on each concentric ring which moves that concentric ring against the thin steel sheet metal blank positioned between the punch surface of said punch and the top surfaces of the concentric rings to urge an annular zone of the thin steel sheet metal blank against said punch surface.

16. The device according to claim 12, further comprising:

means for enabling a peripheral edge portion of the thin steel sheet metal blank to slide between said die and a peripheral blank holder that surrounds said punch, during the deforming of said thin steel sheet metal blank.

17. A draw device for drawing a substantially flat thin sheet metal blank for manufacturing in a single stroke a container of generally frustoconical shape, said draw device comprising:

a punch having a punch surface of generally frustoconical shape;

a die comprising:

a plurality of concentric rings facing said punch surface, said concentric rings having annular top surfaces;

said concentric rings being movable toward the punch surface;

the respective top surfaces of said plurality of concentric rings having contoured shapes; and a peripheral blank holder surrounding said punch;

force exerting means for exerting a predetermined force on said concentric rings to move the top surfaces of said concentric rings a predetermined distance in a direction toward said punch surface;

each of said annular top surfaces of said concentric rings having a shape which is contoured to be complementary to a corresponding annular surface portion of said punch surface that is in an axially facing relation thereto so that the top surfaces of said concentric rings provide the die with an overall die surface shape that substantially corresponds to the frustoconically shaped punch surface when the force exerting means moves the concentric rings said predetermined distance toward said punch surface; and means for enabling a peripheral edge portion of the thin sheet metal blank to slide between said die and the peripheral blank holder that surrounds said punch, during the deforming of the thin sheet metal blank.

18. The device according to claim 17, wherein said force exerting means comprise elastically yieldable elements.

19. The device according to claim 17, wherein said force exerting means comprise springs.

20. The device according to claim 17, wherein said force exerting means exerts a force on each concentric ring which moves that concentric ring against the thin sheet metal blank positioned between the punch surface of said punch and the top surfaces of the concentric rings to urge an annular zone of the thin sheet metal blank against said punch surface.

21. The draw device according to claim 17, wherein the sheet metal blank comprises a sheet of steel that is less than 0.21 mm thick.

* * * * *